US007138969B2

(12) United States Patent
Wang et al.

(10) Patent No.: US 7,138,969 B2
(45) Date of Patent: Nov. 21, 2006

(54) METHOD FOR DRIVING LIGHT EMITTING DIODE

(75) Inventors: Min Kun Wang, Hsinchu (TW); Shih Ting Chang, Taoyuan (TW)

(73) Assignee: Holtek Semiconductor Inc., Hsinchu (TW)

( * ) Notice: Subject to any disclaimer, the term of this patent is extended or adjusted under 35 U.S.C. 154(b) by 491 days.

(21) Appl. No.: 10/781,065

(22) Filed: Feb. 18, 2004

(65) Prior Publication Data

US 2004/0257315 A1 Dec. 23, 2004

(30) Foreign Application Priority Data

Jun. 18, 2003 (TW) ..... 92116592 A

(51) Int. Cl.
*G09G 3/30* (2006.01)

(52) U.S. Cl. ..... 345/76; 345/82; 345/690; 345/212; 315/169.1; 315/169.3; 315/169.4

(58) Field of Classification Search ..... 345/39, 345/44, 46, 55, 76, 82, 690, 211–214; 315/169.1, 315/169.2, 169.4
See application file for complete search history.

(56) References Cited

U.S. PATENT DOCUMENTS 5,844,368 A * 12/1998 Okuda et al. ..... 315/169.3
6,501,226 B1 * 12/2002 Lai et al. ..... 315/169.1
6,608,448 B1 * 8/2003 Boer ..... 315/169.3
6,650,308 B1 * 11/2003 Kawashima ..... 345/76
6,714,177 B1 * 3/2004 Ishizuka ..... 345/76

* cited by examiner

*Primary Examiner*—Henry N. Tran
(74) *Attorney, Agent, or Firm*—Volpe And Koenig, P.C.

(57) ABSTRACT

A method for sequentially driving light emitting diodes (LEDs) arranged in an array is provided. The method includes steps of a) electrically connecting anodes and cathodes of the LEDs to a ground; b) keeping the cathodes of a first part of the LEDs being electrically connected to the ground; c) increasing anode potentials of the LEDs to a first reference potential, and floating the cathodes of other parts of the LEDs simultaneously; d) supplying a current to the first part of the LEDs, and increasing cathode potentials of the other parts of the LEDs to a second reference potential simultaneously; and e) repeating the steps a)–d) for a second part of the LEDs. In which, the first part of the LEDs is arranged in a target row of the array and the second part of the LEDs is arranged in a row next to the target row.

15 Claims, 9 Drawing Sheets

METHOD FOR DRIVING LIGHT EMITTING DIODE

FIELD OF THE INVENTION

The present invention relates to a method for driving a light emitting diode (LED), and particularly to a method for driving an organic light emitting diode (OLED) in a passive matrix mode.

BACKGROUND OF THE INVENTION

In order to meet the requirements of the information equipments, the demand for the flat panel display (FPD) is increasing day by day. In addition, since the simplification, compactness, lightness, and power-saving are the current trends for the electric equipments, the cathode ray tube (CRT) display is gradually replaced by the FPD. Nowadays, the technologies for the FPD include the following, the plasma display, the liquid crystal display, the electroluminescent display, the vacuum fluorescent display, the field emission display, the electrochromic display, and the organic light emitting diode (OLED) display. In which, compared with other display technologies, the OLED display has the following advantages, such as self-luminescing, super-thin appearance, high brightness, high luminance efficiency, short response time, wide visual angle, power saving, wide temperature tolerance, flexible panel, and so forth. Therefore, the OLED display is believed to be the major trend of the display market for the coming generation.

The principles of how the OLED luminesces are as follows. First, an organic film is formed between the transparent anode and the metal cathode by evaporating. Then, electrons and electric holes are supplied therein. Finally, through the reaction between the electrons and the electric holes, the energy is generated and transformed into the visible light. Furthermore, since the material used in the manufacturing of the OLED determines the color of the formed visible light, the requirements of the full-color display can be easily achieved. Presently, the OLED displays manufactured by applying the above principles can be divided into two types, the active matrix organic light emitting diode (AMOLED) display and the passive matrix organic light emitting diode (PMOLED) display, based on the driving method.

As shown in FIG. 1, it is common to drive a PMOLED display by using the row scan technology, which applies the three-phase driving method. In which, the OLED matrix 10 is composed of the plural rows of OLEDs and the plural columns of OLEDs and its driving method is discussed as follows.

(1) For each row of the OLEDs, two kinds of operating phases are provided: a. Current sinker phase, the current is sunk into the OLEDs successfully. b. Reverse bias phase, the object is to increase the durations of the OLEDs.

(2) For each column of the OLEDs, each segment of the OLEDs is driven by a constant current source (not shown). Each segment of the OLEDs is driven by the following three-phase driving method: a. Dis-charge phase, the retaining electric charges of the OLEDs are discharged. b. Pre-charge phase, the potentials of the OLEDs are precharged to the turn-on potentials for performing the best electrifying efficiency when current is sunk in. c. Current driving phase, the current is sunk into the OLEDs to make it to luminesce.

Please refer to FIG. 1, again. In which, the OLED matrix 10 under the conventional passive matrix phase achieves the displaying function by means of the above cyclic charging and discharging processes. However, since the OLED has a parasitic capacitance, which is an inherent physical property, it is not a perfect LED.

Please refer to FIG. 2, which shows a diagram of a practical equivalent circuit of organic light emitting diode according to prior art. In which, both the ideal LED 20 and the parasitic capacitance 21 are shown. It is obvious that the existence of the parasitic capacitance 21 will directly affect the conducting rate of the driving circuit. In other words, the OLED will not be able to perform the expected brightness when the voltage difference between the cathode and the anode of the OLED can not reach to the suitable driving voltage rapidly.

Owing to the existence of the capacitance, the above three-phase OLED array driving method will have the following two problems, which seriously affect the displaying quality. FIGS. 3–5 describes the problems. For the convenience of the description, the capacitance symbol in the drawings represents the OLED (since describing the influence of the capacitance is the object herein), and only three OLEDs within one column of the whole OLED array are shown. The above-mentioned description can be easily understood and can be expansively applied to the whole OLED array by one skilled in the art.

Please refer to FIG. 3, which is a diagram illustrating the first problem resulted from using the conventional three-phase OLED array driving method. When the dis-charge phase initiates, the cathode and anode of the OLED 30 are grounded for being discharged, but the OLEDs 31 and 32 respectively located in the second and third row are under reverse bias phase for being reverse charged. When the pre-charge phase initiates, all the OLEDs 30, 31, 32 are charged by the pre-charge power 33. In which, the voltage of the OLED 30 is charged from 0 to Vpre (a pre-charge voltage value), and the voltages of the OLEDs 31 and 32 are charged from −Vrev (a reverse bias voltage value) to Vpre. From the above, it's known that during the pre-charge phase, the electricity consumed by the OLEDs 31 and 32, which are not necessary to be driven for luminescing, are much more than that consumed by the OLED 30, which is necessary to be driven for luminescing. Therefore, under the above situation, the charging efficiency for each segment during the pre-charge phase is always low. Furthermore, under the passive matrix phase, the row number of the OLED being luminesced is always 1, and the row number of the other OLEDs is N-1, in which the letter N is assumed as the total duty numbers. As mentioned in the above, when the row number of the display panel increases, the charging efficiency of the pre-charge phase is getting worse.

Please refer to FIG. 4, which is a diagram showing the measured wave according to FIG. 3. From the wave obtained practically from the measuring, it's found that the charging process during the pre-charge phase is not operated smoothly. The efficiency of the pre-charge phase will affect the efficiency of the next phase, the current driving phase. In addition, as shown in FIG. 4, the rising time for conducting the OLED is too long.

(2) Please refer to FIG. 5, which is a diagram illustrating the second problem resulted from using the conventional three-phase OLED array driving method. When the row scan is shifted from the first row to the second row, the segments involved in the current driving phase will be switched to be dis-charge phase. In which, the anodes of the OLEDs 50, 51 and 52 are charged to a high potential during the current driving phase. Therefore, at the beginning instant of the dis-charge phase, although the anode potential of the OLED 52 is 0, a voltage drop still occurs to the cathode potential of the OLED 52, owing to the existence of the inherent capacitance effect. Then, the cathode potential of the OLED 52 can start to be charged to Vpre. This problem indeed affects the displaying quality and the situation will be getting worse if the column number of the OLEDs increases. The diagram showing the wave obtained practically from the measuring is shown in FIG. 6.

SUMMARY OF THE INVENTION

In accordance with an aspect of the present invention, a method for sequentially driving light emitting diodes (LEDs) arranged in an array is provided. In which, the method includes steps of a) electrically connecting first electrodes and second electrodes of the LEDs to a ground; b) keeping the second electrodes of a first part of the LEDs being electrically connected to the ground; c) increasing potentials of the first electrodes to a first reference potential, and floating the second electrodes of parts other than the first part of the LEDs simultaneously; d) supplying a current to the first part of the LEDs, and increasing potentials of the second electrodes of the parts other than the first part of the LEDs to a second reference potential simultaneously; and e) repeating the steps a)–d) for a second part of the LEDs.

Preferably, the first part of the LEDs is arranged in a target row of the array.

Preferably, the second part of the LEDs is arranged in a row next to the target row.

Preferably, the array is an organic light emitting diodes (OLEDs) array.

Preferably, the second reference potential is greater than the first reference potential.

Preferably, the first electrodes are anodes of the LEDs.

Preferably, the second electrodes are cathodes of the LEDs.

In accordance with another aspect of the present invention, a method for sequentially driving light emitting diodes (LEDs) arranged in plural rows of an array is provided. In which, the method includes steps of a) dis-charging the LEDs; b) pre-charging a first part of the LEDs; c) floating parts other than the first part of the LEDs; d) proceeding a current driving procedure to the first part of the LEDs, and proceeding a reverse bias procedure to the parts other than the first part of the LEDs simultaneously; and e) repeating the steps a)–d) for a second part of the LEDs. In which, the first part of the LEDs is arranged in a target row and the second part of the LEDs is arranged in a row next to the target row.

Preferably, the array is an organic light emitting diodes (OLEDs) array.

Preferably, the step a) is performed by electrically connecting anodes and cathodes of the LEDs to a ground.

Preferably, the step b) is performed by keeping the cathodes of the first part of the LEDs being electrically connected to the ground and increasing anode potentials of the LEDs to a first reference potential.

Preferably, increasing cathode potentials of the parts other than the first part of the LEDs to a second reference potential performs the reverse bias procedure.

Preferably, the second reference potential is greater than the first reference potential.

Preferably, the step of c) is performed by floating the cathodes of the parts other than the first part of the LEDs.

Preferably, supplying a current to the first part of the LEDs performs the current driving procedure.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
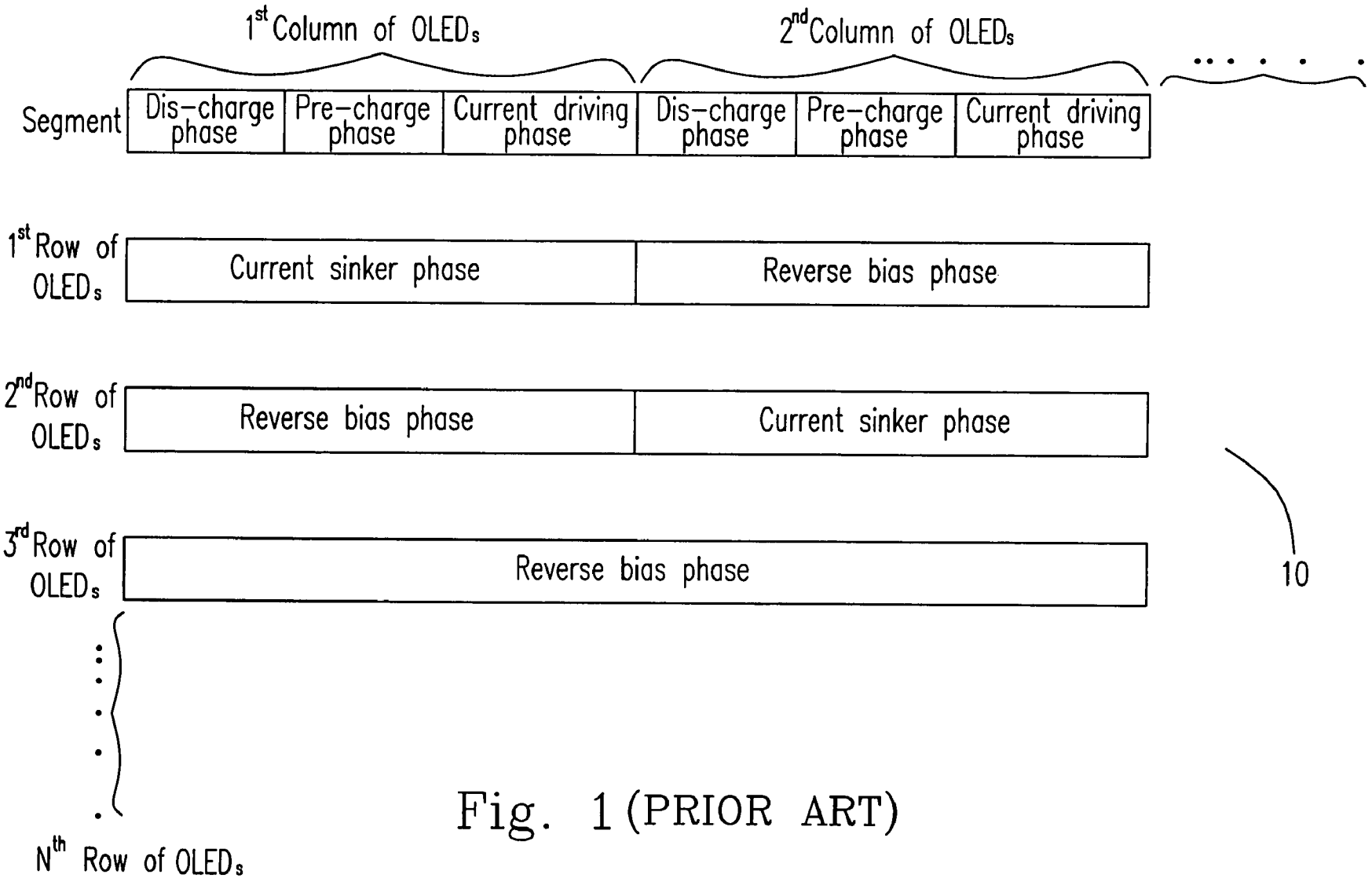
Fig. 1 (PRIOR ART)
FIG. 1 shows a diagram of the three-phase OLED array driving method used in a conventional row scan technology according to the prior art.
Figure 2:
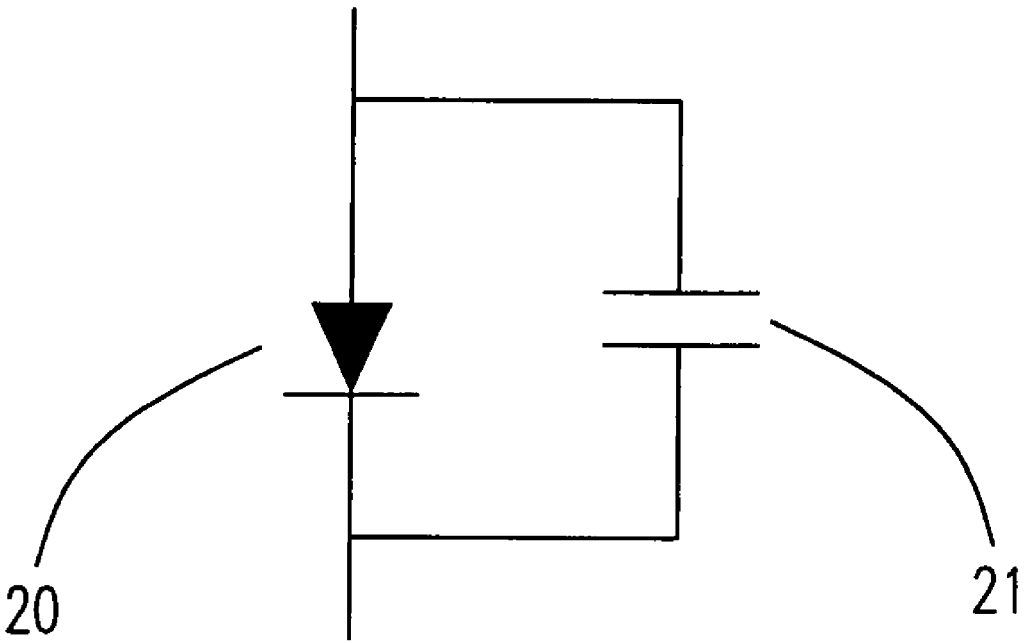
Fig. 2(PRIOR ART)
FIG. 2 shows a diagram of a practical equivalent circuit of organic light emitting diode according to prior art.
Figure 3:
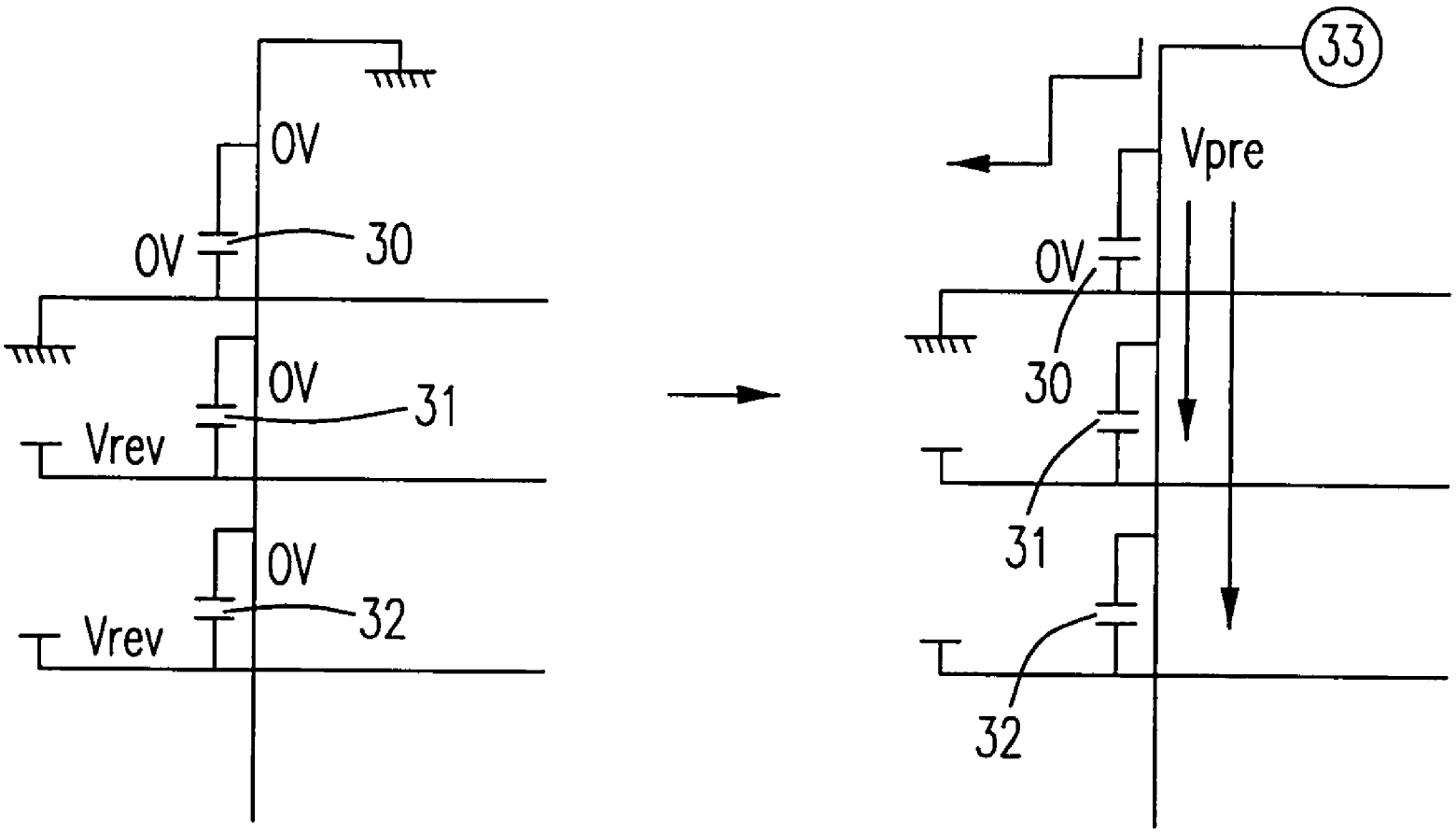
Fig. 3(PRIOR ART)
FIG. 3 is a diagram illustrating the first problem resulted from using the conventional three-phase OLED array driving method according to the prior art.
Figure 4:
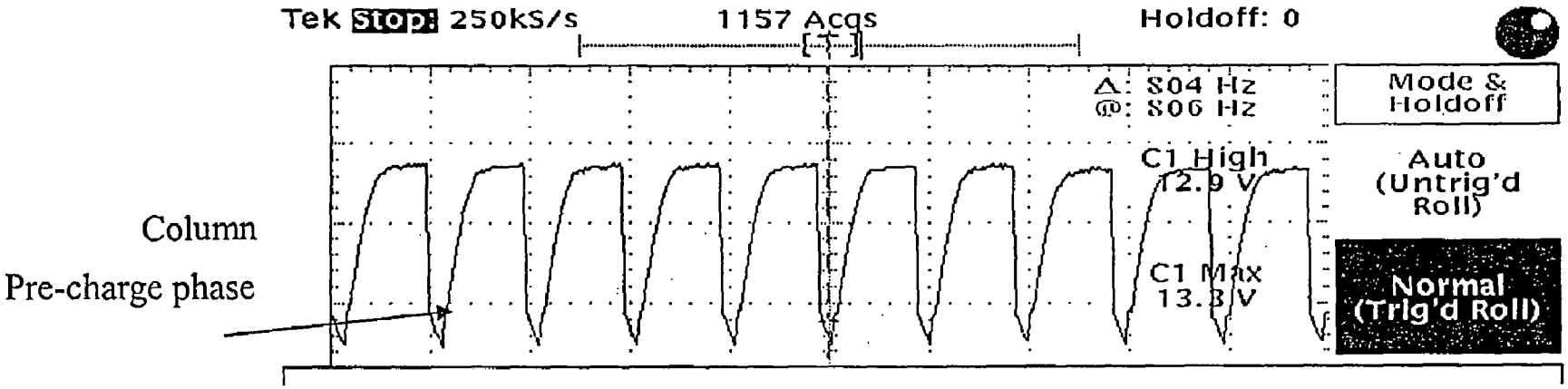
Fig. 4(PRIOR ART)
FIG. 4 is a diagram showing the measured wave according to FIG. 3.
Figure 5:
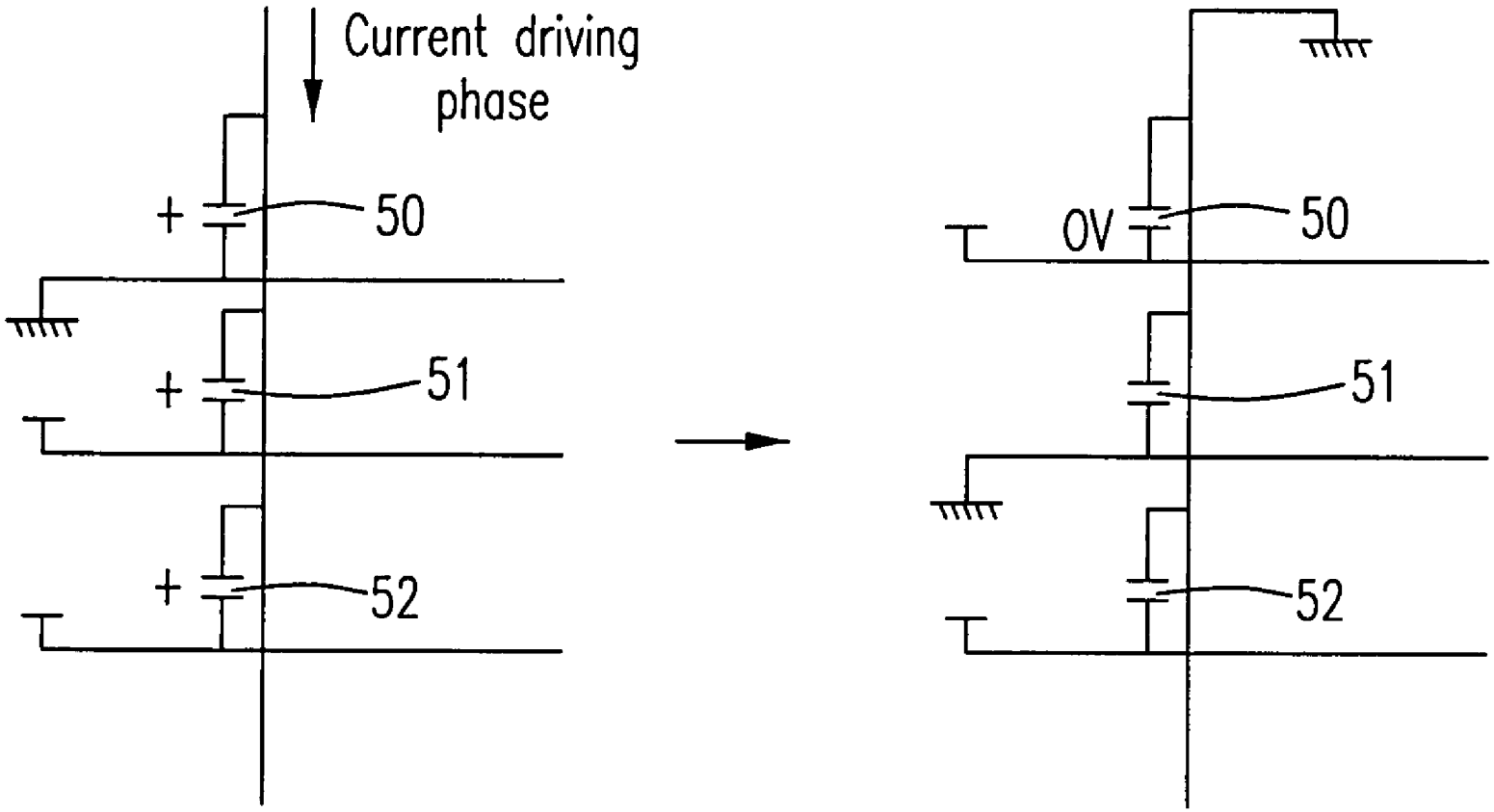
Fig. 5(PRIOR ART)
FIG. 5 is a diagram illustrating the second problem resulted from using the conventional three-phase OLED array driving method.
Figure 6:
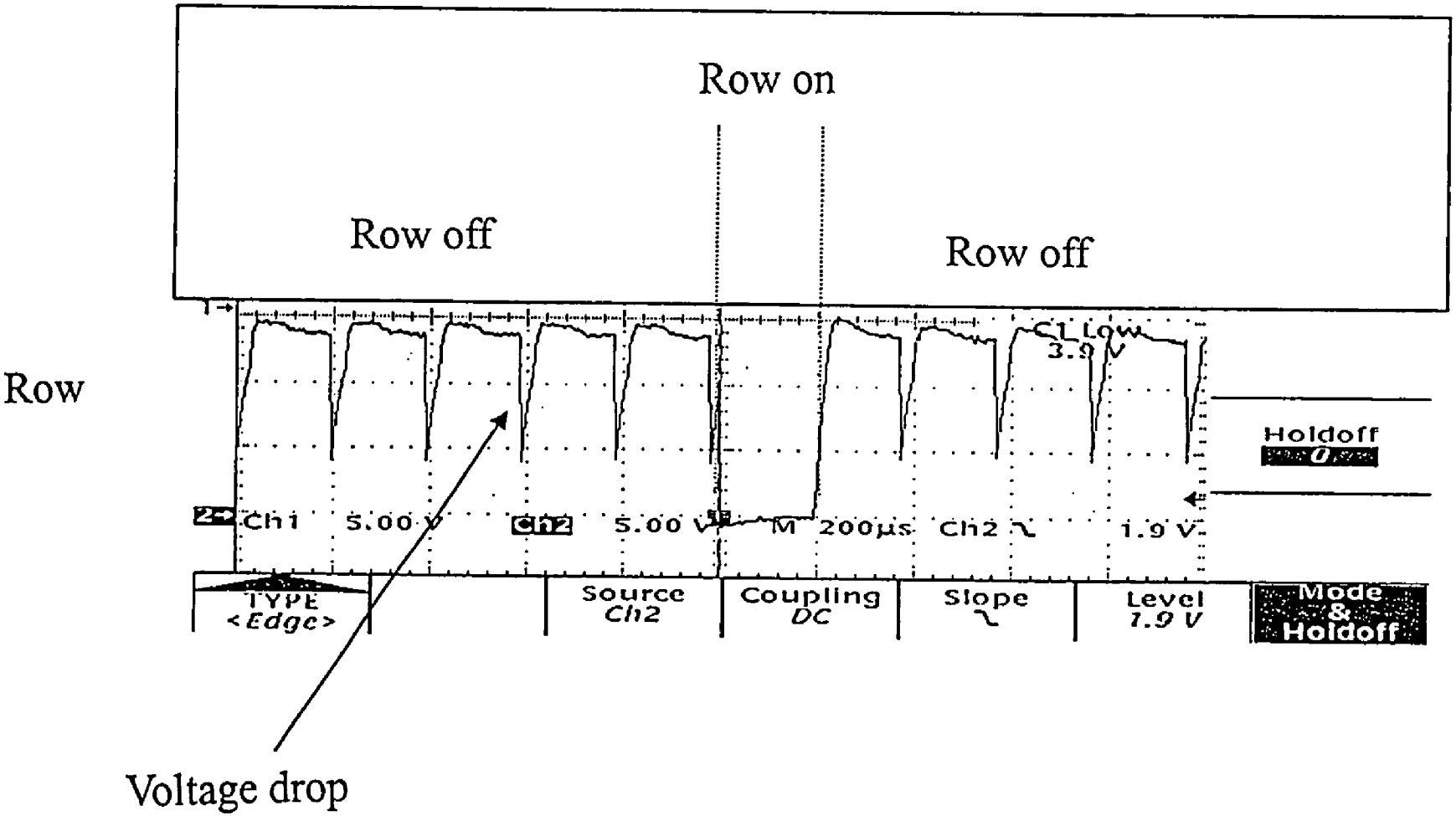
Fig. 6(PRIOR ART)
FIG. 6 is a diagram showing the wave obtained practically from the measuring according to FIG. 5.
Figure 7:
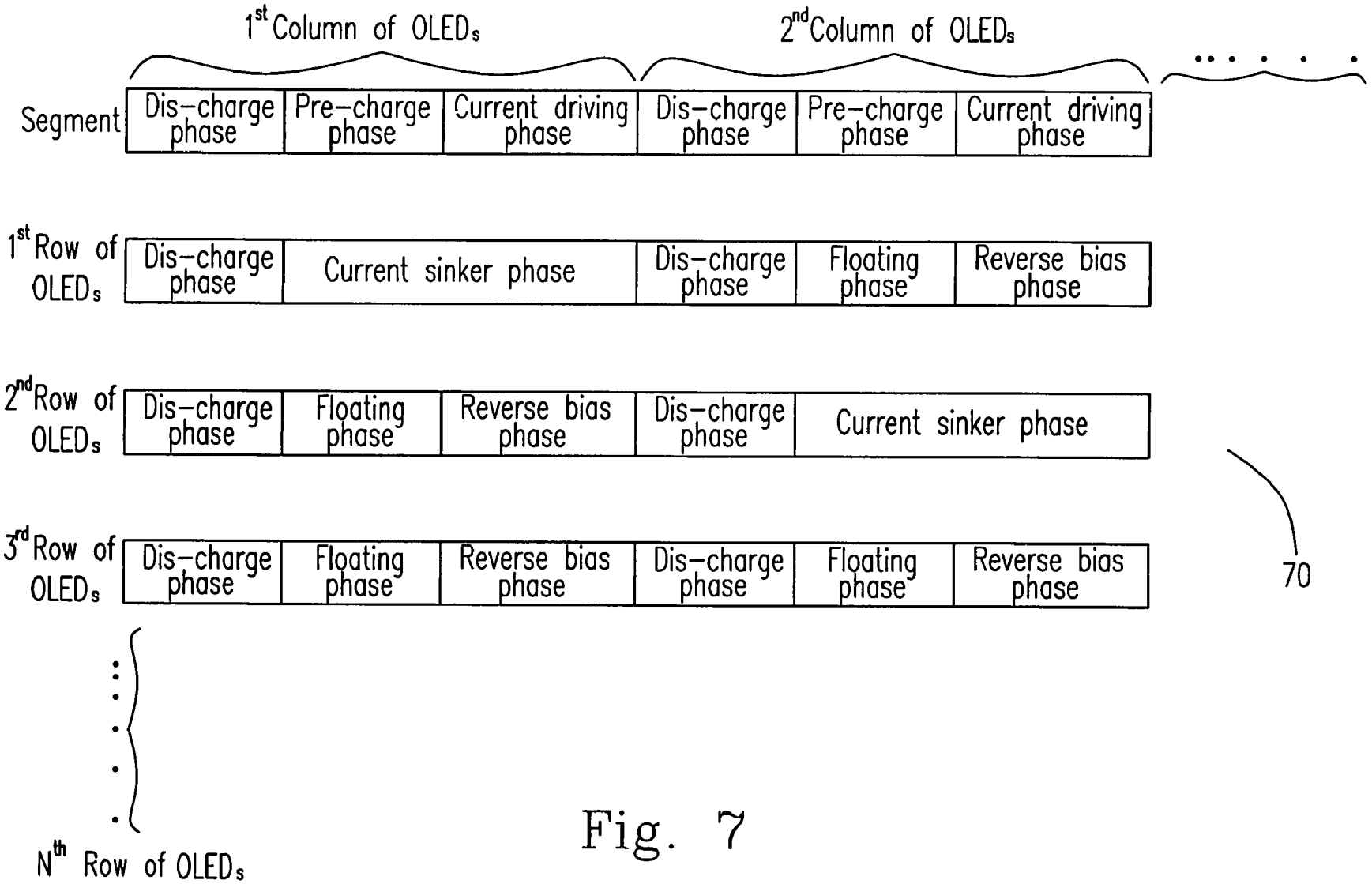
FIG. 7 is a diagram illustrating the OLED array driving method according to a preferred embodiment of the present invention.
Figure 8:
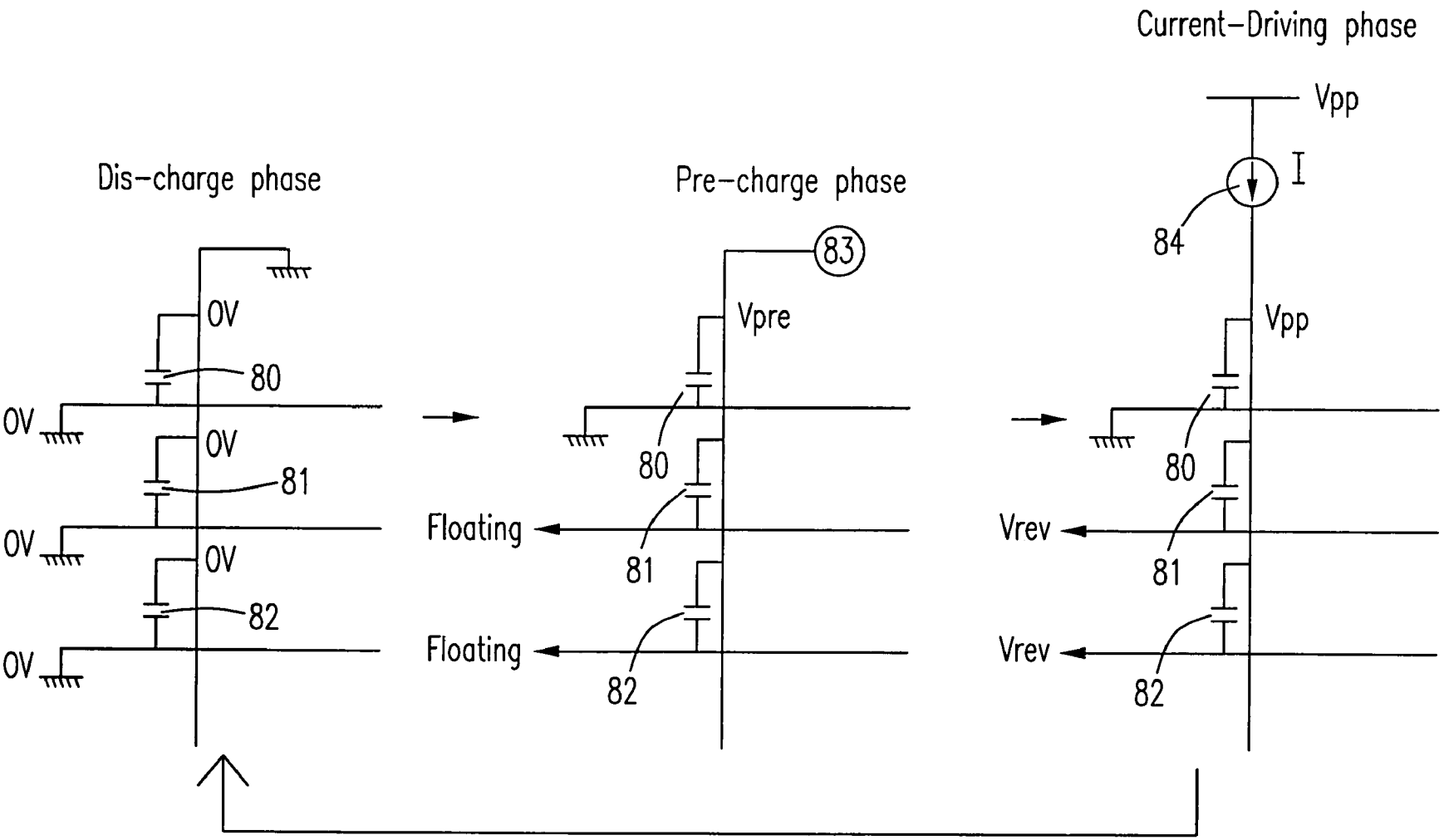
FIG. 8 is a diagram showing the continuous processes in the OLED array driving method according to the preferred embodiment of the present invention.
Figure 9:
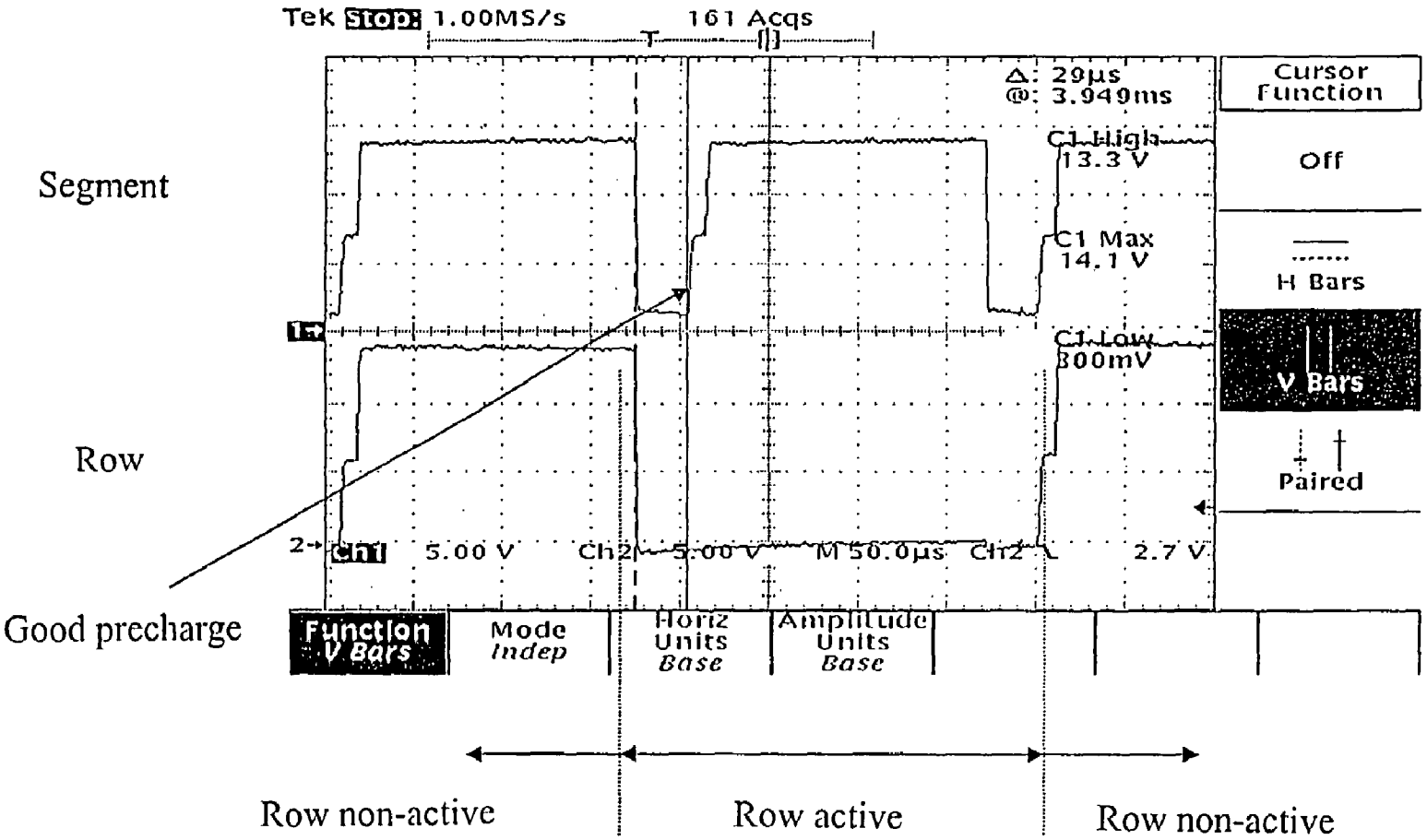
FIG. 9 shows a practically measured wave diagram of the OLED array driving method according to FIGS. 7 and 8.

The technical features of a preferred embodiment according to the present invention are described in FIGS. 7 to 9. For the convenience of the description, the capacitance symbol in the drawings represents the OLED, and only three OLEDs within one column of the whole OLED array are shown. The above-mentioned description can be easily understood and can be expansively applied to the whole OLED array by one skilled in the art.

Please refer to FIG. 7, which is a diagram illustrating the OLED array driving method according to a preferred embodiment of the present invention. In which, the OLED array 70 is composed of plural rows and plural columns of the OLEDs. The difference between the driving methods of the present invention and that of the prior art is that there are four operation phases provided for each row of the OLED array in the driving method of the present invention: a. Dis-charge phase, all the row segments are connected to the ground for being discharged. b. Floating phase, the object here is to confirm that the electric charges are exactly supplied to the desired row segments during the pre-charge phase. c. Current sinker phase, the object here is to successfully supply the current to the OLEDs. d. Reverse bias phase, the object here is to lengthen the durations of the OLEDs. However, the segments within each column of the OLEDs are still driven by the conventional three-phase driving method initiated by a constant current source. The continuous diagram of the OLED array driving method according to the present invention will be described clearly with reference to FIG. 8.

Please refer to FIG. 8, which is a diagram showing the continuous process in the OLED array driving method according to a preferred embodiment of the present invention. In which, when the OLED array is in the dis-charge phase, the cathodes and anodes of the OLEDs within each column segment are connected to the ground, so that the panel composed of the OLED array would be in a clean initial condition. When the pre-charge phase initiates, only the cathodes of the OLEDs within the target row are connected to the ground, wherein the target row is the row where the OLED 80 is optioned. The anodes of the OLED within the target row are pre-charged to Vpre. Meanwhile, the cathodes of all the OLEDs other than those within the target row are floating, which is also the main difference between the driving method of the present invention and that of the prior art. Since the potentials of the anodes of the OLEDs other than that within the target row are at Vpre as well, the electric charges of the pre-charging power 83 can only be transmitted via the target row, where the OLED 80 is located. Thereby, the energy and time consumed for pre-charging the metal oxide semiconductor field effect transistor (MOSFET) sources, which drive the OLEDs, will be reduced. That is because that some pre-charging energy will be consumed meaninglessly due to the redundant volumes of the MOSFET, and a long pre-charging time results in the low luminance efficiency of the OLEDs. While the current driving phase initiates and the OLEDs within the target row beginning luminescing owing to the current from the current source 84 flowed to the target row, the cathode potentials of the OLEDs within the row other than those of the target row are charged to Vrev simultaneously. At this time, Vrev is higher than the reference voltage (Vpp) value, so the OLEDs within the rows other than the target row will be in the reverse bias phase. The durations of the OLEDs can be increased accordingly.

So far, the first problem in the conventional driving method has been solved completely. As to the second problem, which is the potential drop resulted from the inherent capacitance and occurs when the scanned row is changed in the row scan, it will be solved since all cathodes of the OLEDs are connected to the ground. All the cathodes of the OLEDs within the new scanned row will be shifted to be in the dis-charge phase, when switching the scanned row from the target row to its next row and the column segments are shifted from the current driving phase to the dis-charge phase.

The driving method according to the present invention will be understood more clearly with reference to the above descriptions and FIG. 9. Please refer to FIG. 9, which clearly shows some advantages of the driving method according to the present invention when the driving method provided in the present invention drives the OLEDs in a passive matrix mode. As shown in FIG. 9, the OLEDs driven by the driving method of the present invention not only posses the same luminance efficiency as that of the prior art, but also has no the problems resulted from the inherent parasitic capacitances of the OLEDs.

In view of the aforesaid description, the present invention does provide a driving method for OLEDs, which solves the problems, resulted from the parasitic capacitances of the OLEDs by applying a step of floating and sequentially driving the OLEDs within the specific positions. Furthermore, since the currents are only transmitted to the OLEDs within the specific positions, the energy and time for driving the OLEDs can be reduced. Therefore, the present invention is extremely suitable for being applied in industrial production.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims that are to be accorded with the broadest interpretation so as to encompass all such modifications and similar structures.

What is claimed is:

1. A method for sequentially driving light emitting diodes (LEDs) arranged in an array, comprising steps of a) electrically connecting first electrodes and second electrodes of said LEDs to a ground;

b) keeping said second electrodes of a first part of said LEDs being electrically connected to said ground;

c) increasing potentials of said first electrodes to a first reference potential, and floating said second electrodes of parts other than said first part of said LEDs simultaneously;

d) supplying a current to said first part of said LEDs, and increasing potentials of said second electrodes of said parts other than said first part of said LEDs to a second reference potential simultaneously; and e) repeating said steps a)–d) for a second part of said LEDs.

2. The method as claimed in claim 1, wherein said first part of said LEDs is arranged in a target row of said array.

3. The method as claimed in claim 2, wherein said second part of said LEDs is arranged in a row next to said target row.

4. The method as claimed in claim 1, wherein said array is an organic light emitting diodes (OLEDs) array.

5. The method as claimed in claim 1, wherein said second reference potential is greater than said first reference potential.

6. The method as claimed in claim 1, wherein said first electrodes are anodes of said LEDs.

7. The method as claimed in claim 1, wherein said second electrodes are cathodes of said LEDs.

8. A method for sequentially driving light emitting diodes (LEDs) arranged in plural rows of an array, comprising steps of:

a) dis-charging said LEDs;

b) pre-charging a first part of said LEDs;

c) floating parts other than said first part of said LEDs;

d) proceeding a current driving procedure to said first part of said LEDs, and proceeding a reverse bias procedure to said parts other than said first part of said LEDs simultaneously; and e) repeating said steps a)–d) for a second part of said LEDs, in which said first part of said LEDs is arranged in a target row, and said second part of said LEDs is arranged in a row next to said target row.

9. The method as claimed in claim 8, wherein said array is an organic light emitting diodes (OLEDs) array.

10. The method as claimed in claim 8, wherein said step a) is performed by electrically connecting anodes and cathodes of said LEDs to a ground.

11. The method as claimed in claim 10, wherein said step b) is performed by keeping said cathodes of said first part of said LEDs being electrically connected to said ground and increasing anode potentials of said LEDs to a first reference potential.

12. The method as claimed in claim 11, wherein said reverse bias procedure is performed by increasing cathode potentials of said parts other than said first part of said LEDs to a second reference potential.

13. The method as claimed in claim 12, wherein said second reference potential is greater than said first reference potential.

14. The method as claimed in claim 10, wherein said step of c) is performed by floating said cathodes of said parts other than said first part of said LEDs.

15. The method as claimed in claim 8, wherein said current driving procedure is performed by supplying a current to said first part of said LEDs.

* * * * *